US011326623B2

(12) United States Patent
Liu

(10) Patent No.: US 11,326,623 B2
(45) Date of Patent: May 10, 2022

(54) FAN NOISE-LOWERING STRUCTURE

(71) Applicant: ASIA VITAL COMPONENTS CO., LTD., New Taipei (TW)

(72) Inventor: Wen-Hao Liu, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 16/920,429

(22) Filed: Jul. 3, 2020

(65) Prior Publication Data

US 2020/0400163 A1 Dec. 24, 2020

Related U.S. Application Data

(63) Continuation-in-part of application No. 15/979,485, filed on May 15, 2018, now Pat. No. 10,746,024.

(51) Int. Cl.
*F04D 29/66* (2006.01)
*F04D 29/046* (2006.01)

(52) U.S. Cl.
CPC ..... *F04D 29/661* (2013.01); *F04D 29/046* (2013.01)

(58) Field of Classification Search
CPC ..... F04D 19/002; F04D 27/0207–0238; F04D 29/40; F04D 29/403; F04D 29/52; F04D 29/522; F04D 29/526; F04D 29/545; F04D 29/68; F04D 29/681; F04D 29/682; F04D 29/684
See application file for complete search history.

(56) References Cited

U.S. PATENT DOCUMENTS 5,308,225 A 5/1994 Koff
2008/0031722 A1* 2/2008 Yoshida ..... F04D 29/526 415/68
2008/0232961 A1* 9/2008 Lin ..... F04D 25/0613 415/213.1
2011/0255957 A1 10/2011 Inada
2013/0121840 A1* 5/2013 Liu ..... F04D 29/326 416/244 R

FOREIGN PATENT DOCUMENTS

CN 2416263 Y 1/2001
CN 201928112 U 8/2011
CN 102478003 A 5/2012
(Continued)

*Primary Examiner* — Eldon T Brockman
*Assistant Examiner* — Brian O Peters
(74) *Attorney, Agent, or Firm* — Demian K. Jackson; Jackson IPG PLLC

(57) ABSTRACT

A fan noise-lowering structure includes a fan frame and a connection section. The fan frame has a bottom side and a circumferential wall. The circumferential wall defines an airflow passage. Two ends of the airflow passage respectively have an inlet and an outlet. The connection section is disposed on inner side or outer side of the circumferential wall. The connection section has an internal passage. Two ends of the internal passage respectively have an inlet end and an outlet end. The outlet end is disposed on the inner side of the circumferential wall in connection with the airflow passage near the inlet. The inlet end is disposed on the bottom side in flush with the outlet. The connection section serves to guide the high-pressure air at the outlet to jet to the inlet so as to achieve multiple noise-lowering effects.

5 Claims, 4 Drawing Sheets

(56) References Cited

FOREIGN PATENT DOCUMENTS

| | | | |
|---|---|---|---|
| CN | 105570157 | A | 5/2016 |
| CN | 205841322 | U | 12/2016 |
| CN | 106968724 | A | 7/2017 |
| CN | 105673532 | B | 2/2019 |
| DE | 102015119664 | B4 | 11/2021 |
| EP | 3124794 | B1 | 8/2020 |

* cited by examiner

FAN NOISE-LOWERING STRUCTURE

The present application is a continuation in part of U.S. patent application Ser. No. 15/979,485, filed on Aug. 15, 2018.

BACKGROUND OF THE INVENTION

1. Field of the Invention

The present invention relates generally to a fan noise-lowering structure, and more particularly to a fan noise-lowering structure including a connection section. The connection section serves to guide the high-pressure airflow produced at the outlet of the fan to jet to the inlet so as to achieve multiple noise-lowering effects.

2. Description of the Related Art

The noise made by the fan is always one of the problems existing in the field of fans to be improved. The conventional technical means for solving the fan noise problem is to use a circuit to control the rotational speed or change the fan structure. A prior art discloses a technique in which an airflow jet is disposed on the dynamic blades or the frame wall of the static blades to restrain the vortex. However, it is necessary to add an external connected airflow jet source to the fan. This cannot be achieved in a limited space. In addition, the extra external connected airflow jet source will lead to increase of the cost.

It is therefore tried by the applicant to provide a fan noise-lowering structure, which can lower the noise of the fan without using additional equipment.

SUMMARY OF THE INVENTION

It is therefore a primary object of the present invention to provide a fan noise-lowering structure, in which a self-airflow jet noise-lowering structure is disposed on the fan frame to solve he fan noise problem.

To achieve the above and other objects, the fan noise-lowering structure of the present invention includes a fan frame and a connection section.

The fan frame has a bottom side and a circumferential wall. The circumferential wall is normal to the bottom side and annularly disposed on one face of the bottom side. The circumferential wall defines an airflow passage. Two ends of the airflow passage respectively have an inlet and an outlet. The connection section is disposed on inner side or outer side of the circumferential wall. The connection section has an internal passage. Two ends of the internal passage respectively have an inlet end and an outlet end. The outlet end is disposed on the inner side of the circumferential wall in connection with the airflow passage near the inlet. The inlet end is disposed on the bottom side in flush with the outlet. The connection section serves to guide the high-pressure air at the outlet to jet to the inlet so as to achieve multiple noise-lowering effects.

Still to achieve the above and other objects, the fan noise-lowering structure of the present invention includes a first fan, a second fan and a connection section.

The first fan has a first bottom side and a first circumferential wall. The first circumferential wall is normal to the first bottom side and annularly disposed on one face of the first bottom side. The first circumferential wall defines a first airflow passage. Two ends of the first airflow passage respectively have a first inlet and a first outlet.

The second fan has a second bottom side and a second circumferential wall. The second circumferential wall is normal to the second bottom side and annularly disposed on one face of the second bottom side. The second circumferential wall defines a second airflow passage. Two ends of the second airflow passage respectively have a second inlet and a second outlet. The first and second fans are vertically assembled with each other.

The connection section is disposed on inner sides or outer sides of the first and second circumferential walls. The connection section has an internal passage. The internal passage has a first inlet end, a first outlet end, a second inlet end and a second outlet end. The first inlet end is connected with the second outlet end. The first outlet end is disposed on the inner side of the first circumferential wall in connection with the first airflow passage near the first inlet. The second inlet end is disposed on the second bottom side of the second fan in flush with the second outlet.

By means of the self-airflow jet structure of the present invention, the airflow with higher pressure at the outlet of the fan is guided to jet to the inlet of the fan so as to lower the noise of the entire fan.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
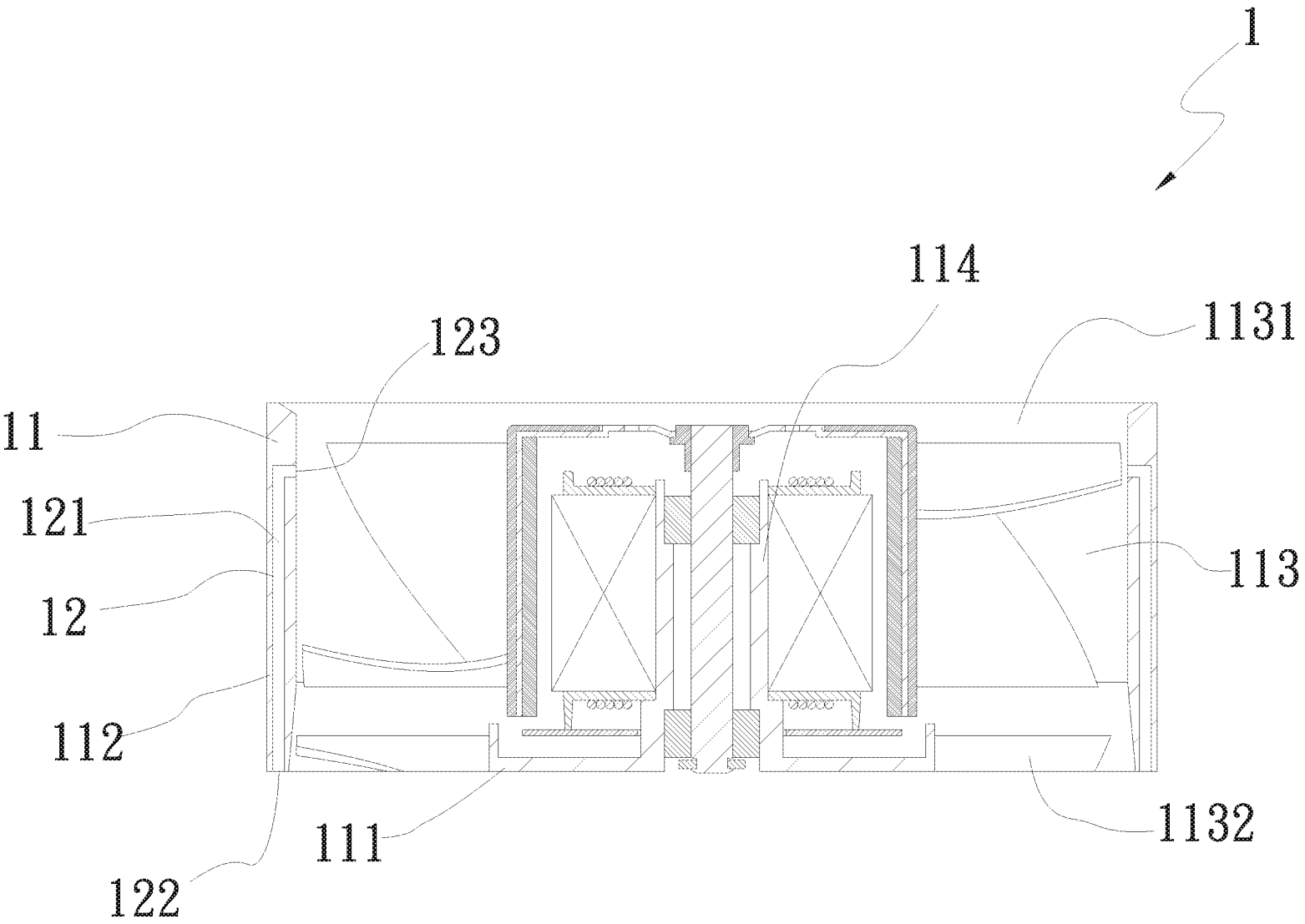
FIG. 1 is a sectional view of a first embodiment of the fan noise-lowering structure of the present invention.

Please refer to FIG. 1, which is a sectional view of a first embodiment of the fan noise-lowering structure of the present invention. As show in the drawing, the fan noise-lowering structure 1 of the present invention includes a fan frame 11 and a connection section 12.

The fan frame 11 has a bottom side 111 and a circumferential wall 112. The circumferential wall 112 is normal to the bottom side 111 and annularly disposed on one face of the bottom side 111. The circumferential wall 112 defines an airflow passage 113. Two ends of the airflow passage 113 respectively have an inlet 1131 and an outlet 1132. The outlet 1132 is positioned at one end of the airflow passage 113 near the bottom side 111. The inlet 1131 is positioned at the other end of the airflow passage 113 opposite to the outlet 1132.

The connection section 12 is disposed on inner side or outer side of the circumferential wall 112. In this embodiment, the connection section 12 is disposed on the inner side of the circumferential wall 112 for illustration purposes. The connection section 12 has an internal passage 121. Two ends of the internal passage 121 respectively have an inlet end 122 and an outlet end 123. The inlet end 122 is disposed on the bottom side 111 in flush with the outlet 1132 of the fan frame 11. The outlet end 123 is disposed on the inner side of the circumferential wall 112 in connection with the airflow passage 113 near the inlet 1131.

The bottom side 111 has a bearing cup 113 perpendicularly extending from the bottom side 111.

Figure 2:
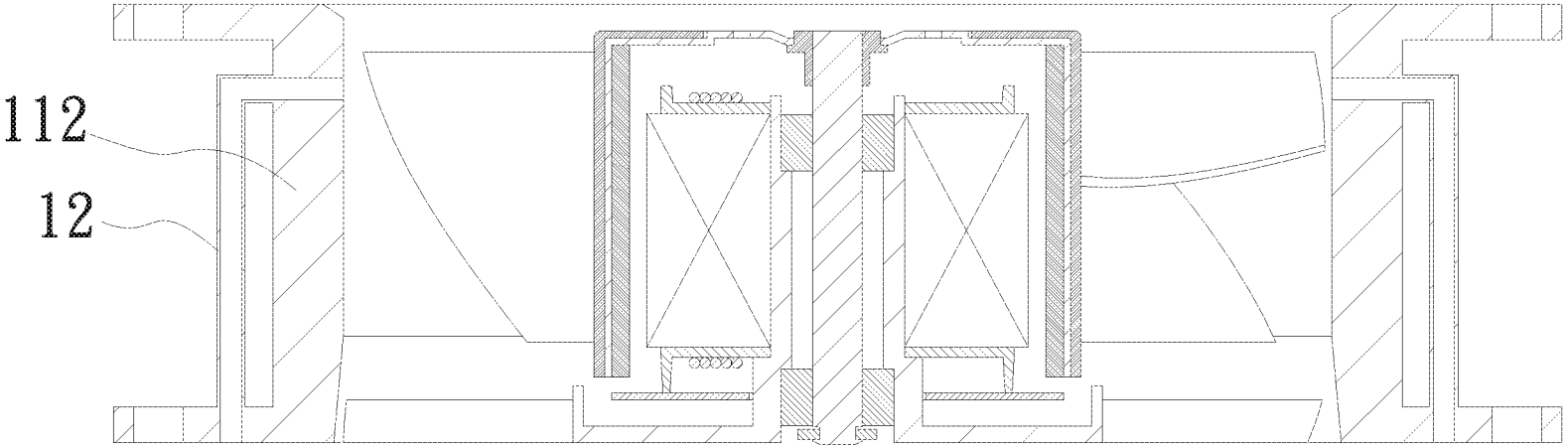
FIG. 2 is a sectional view of a second embodiment of the fan noise-lowering structure of the present invention.

Please now refer to FIG. 2, which is a sectional view of a second embodiment of the fan noise-lowering structure of the present invention. The second embodiment is partially identical to the first embodiment in structure and thus will not be redundantly described hereinafter. The second embodiment is different from the first embodiment in that the connection section 12 is disposed on the outer side of the circumferential wall 112 on four corners of the fan frame 11.

Figure 3:
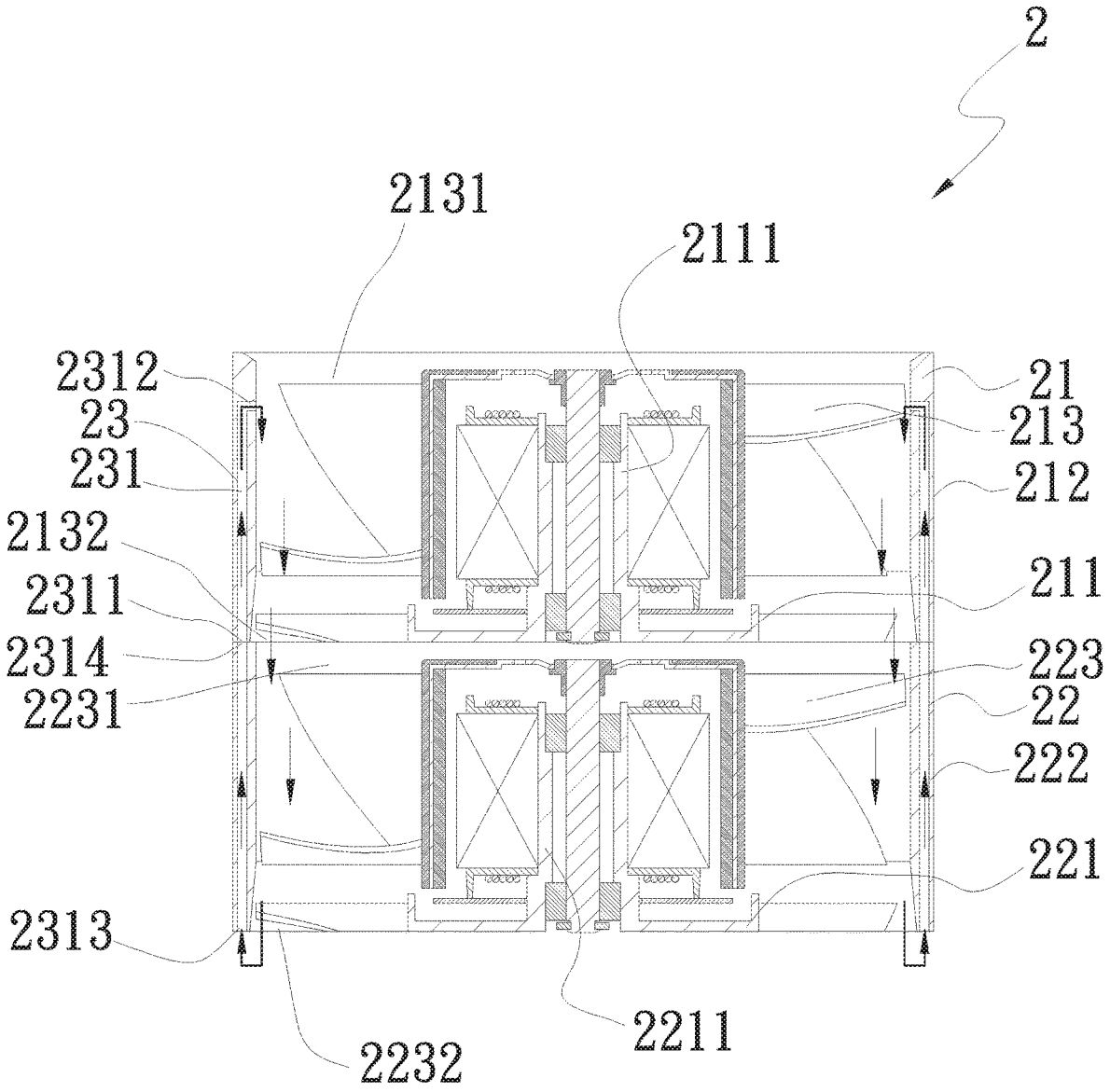
FIG. 3 is a sectional view of a third embodiment of the fan noise-lowering structure of the present invention.

Please now refer to FIG. 3, which is a sectional view of a third embodiment of the fan noise-lowering structure of the present invention. According to the third embodiment, the fan noise-lowering structure 2 of the present invention includes a first fan 21, a second fan 22 and a connection section 23.

The first fan frame 21 has a first bottom side 211 and a first circumferential wall 212. The first circumferential wall 212 is normal to the first bottom side 211 and annularly disposed on one face of the first bottom side 211. The first circumferential wall 212 defines a first airflow passage 213. Two ends of the first airflow passage 213 respectively have a first inlet 2131 and a first outlet 2132.

The second fan frame 22 has a second bottom side 221 and a second circumferential wall 222. The second circumferential wall 222 is normal to the second bottom side 221 and annularly disposed on one face of the second bottom side 221. The second circumferential wall 222 defines a second airflow passage 223. Two ends of the second airflow passage 223 respectively have a second inlet 2231 and a second outlet 2232. The first and second fans 21, 21 are vertically serially connected and assembled with each other. The first outlet 2132 is mated with the second inlet 2231.

The connection section 23 has an internal passage 231. The internal passage 231 has a first inlet end 2311, a first outlet end 2312, a second inlet end 2313 and a second outlet end 2314. The first inlet end 2311 is connected with the second outlet end 2314. The first outlet end 2312 is disposed on the inner side of the first circumferential wall 212 in connection with the first airflow passage 213 near the first inlet 2131. The second inlet end 2313 is disposed on the second bottom side 221 of the second fan 22 in flush with the second outlet 2232.

The second inlet end 2314 of the internal passage 231 of the connection section 23 serves to guide the higher-pressure airflow to jet from the second outlet 2232 of the second fan 22 to the first inlet 2131 of the first fan 21 so as to lower the noise.

The first bottom side 211 has a first bearing cup 2111 perpendicularly extending from the first bottom side 211. The second bottom side 221 has a second bearing cup 2211 perpendicularly extending from the second bottom side 221.

The first outlet 2132 is positioned at one end of the first airflow passage 213 near the first bottom side 211. The first inlet 2131 is positioned at the other end of the first airflow passage 213 opposite to the first outlet 2132. The first inlet end 2311 is adjacent to the first outlet 2132. The first outlet end 2312 is adjacent to the first inlet 2131.

The second outlet 2232 is positioned at one end of the second airflow passage 223 near the second bottom side 221. The second inlet 2231 is positioned at the other end of the second airflow passage 223 opposite to the second outlet 2232.

Figure 4:
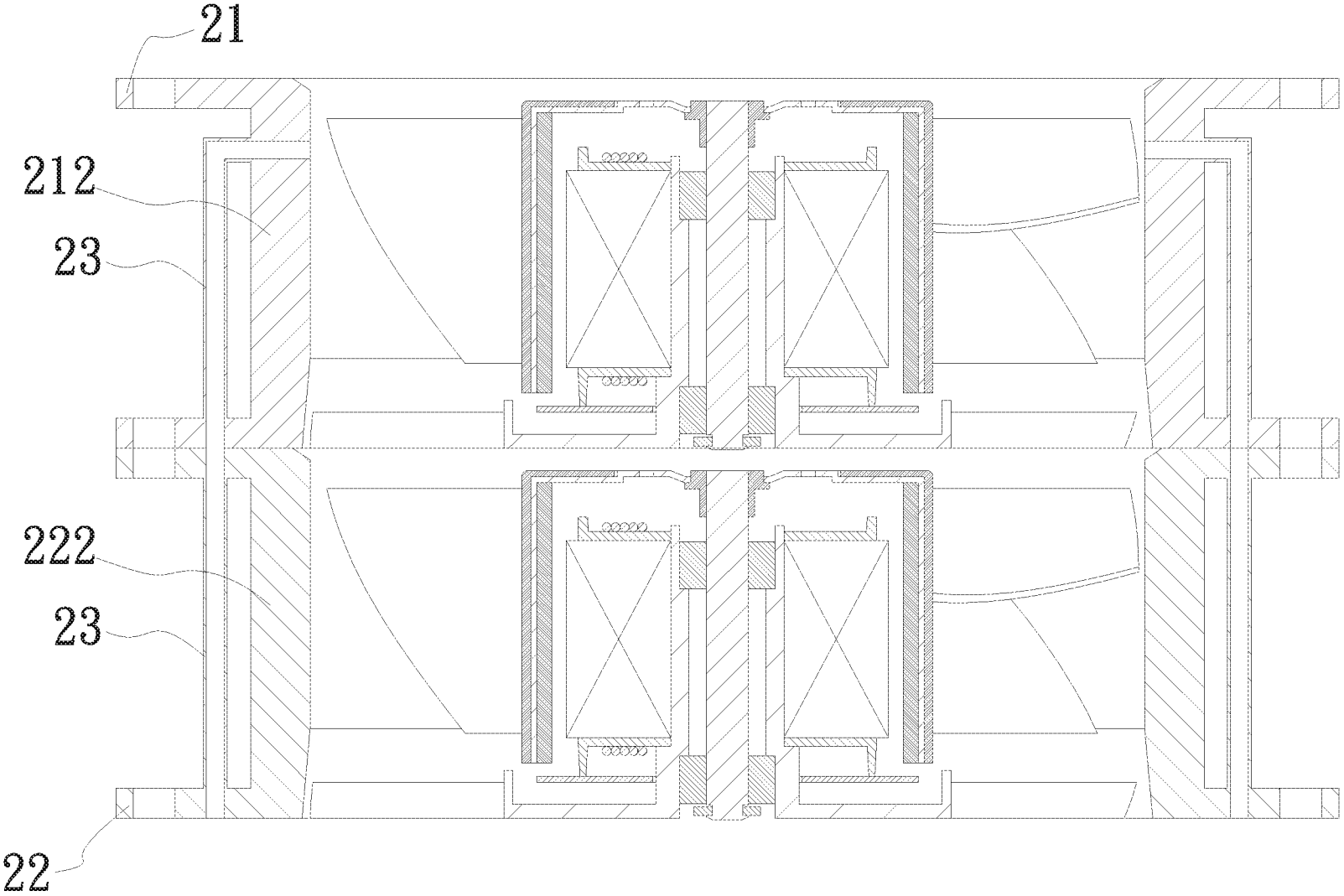
FIG. 4 is a sectional view of a fourth embodiment of the fan noise-lowering structure of the present invention.

Please now refer to FIG. 4, which is a sectional view of a fourth embodiment of the fan noise-lowering structure of the present invention. The fourth embodiment is partially identical to the third embodiment in structure and thus will not be redundantly described hereinafter. The fourth embodiment is different from the third embodiment in that the connection section 23 is disposed on the outer sides of the first and second circumferential walls 212, 222 on four corners of the first and second fans 21, 22.

In the present invention, the airflow of the high-pressure section (the outlet) of the fan is jetted to the low-pressure section (the inlet) of the fan so as to lower the noise of the fan.

In the present invention, the inlet end of the connection section is disposed on the bottom side of the fan frame in flush with the outlet. Accordingly, when the outlet of the fan is full of the airflow, the excessive airflow can be poured from the inlet end of the connection section into the internal passage of the connection section. The airflow is then exhausted from the outlet end of the connection section to jet to the inlet of the fan frame so as to lower the noise of the fan.

The connection section can be disposed in the wall of the fan frame itself or externally added to the fan frame. This is not limited.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan noise-lowering structure comprising:

a fan frame having a bottom side and a circumferential wall, the circumferential wall being normal to the bottom side and annularly disposed on one face of the bottom side, the circumferential wall defining an airflow passage, two ends of the airflow passage respectively having an inlet and an outlet; and a connection section disposed on inner side or outer side of the circumferential wall, the connection section having an internal passage, two ends of the internal passage respectively having an inlet end and an outlet end, the outlet end being disposed on the inner side of the circumferential wall in connection with the airflow passage proximate the inlet, the inlet end being disposed on the bottom side of the fan frame in flush with the outlet.

2. The fan noise-lowering structure as claimed in claim 1, wherein the bottom side has a bearing cup perpendicularly extending from the bottom side.

3. A fan noise-lowering structure comprising:

a first fan having a first bottom side and a first circumferential wall, the first circumferential wall being normal to the first bottom side and annularly disposed on one face of the first bottom side, an inner circumference of the first circumferential wall defining a first airflow passage, two ends of the first airflow passage respectively having a first inlet and a first outlet;

a second fan having a second bottom side and a second circumferential wall, the second circumferential wall being normal to the second bottom side and annularly disposed on one face of the second bottom side, an inner circumference of the second circumferential wall defining a second airflow passage, two ends of the second airflow passage respectively having a second inlet and a second outlet, the first and second fans being vertically assembled with each other; and a connection section disposed on inner sides or outer sides of the first and second circumferential walls, the connection section having an internal passage, the internal passage having a first inlet end, a first outlet end, a second inlet end and a second outlet end, the first inlet end being connected with the second outlet end, the first outlet end being disposed on the inner side of the first circumferential wall in connection with the first airflow passage proximate the first inlet, the second inlet end being disposed on the second bottom side of the second fan in flush with the second outlet.

4. The fan noise-lowering structure as claimed in claim 3, wherein the first bottom side has a first bearing cup perpendicularly extending from the first bottom side, the second bottom side having a second bearing cup perpendicularly extending from the second bottom side.

5. The fan noise-lowering structure as claimed in claim 3, wherein the first inlet is positioned one end of the first airflow passage opposite to the first outlet, the first inlet end being adjacent to the first outlet, the second outlet end being connected with the first inlet end in adjacency to the second inlet, the second outlet being positioned at one end of the second airflow passage proximate the second bottom side, the second inlet being positioned at the other end of the second airflow passage opposite to the second outlet, the second inlet end being adjacent to the second outlet.

* * * * *